US007639960B2

(12) United States Patent
Kobashi et al.

(10) Patent No.: US 7,639,960 B2
(45) Date of Patent: Dec. 29, 2009

(54) CHARGER, IMAGE FORMING APPARATUS, AND CHARGE CONTROL METHOD

(75) Inventors: Masaru Kobashi, Matsumoto (JP); Koji Migita, Matsumoto (JP); Masashi Nakatsu, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 11/954,762

(22) Filed: Dec. 12, 2007

(65) Prior Publication Data

US 2008/0131155 A1 Jun. 5, 2008

(30) Foreign Application Priority Data

Dec. 12, 2006 (JP) ..... 2006-334498

(51) Int. Cl.
*G03G 15/02* (2006.01)

(52) U.S. Cl. ..... 399/50; 399/174; 399/175; 399/176

(58) Field of Classification Search ..... 399/50, 399/168, 174–176; 361/221, 225
See application file for complete search history.

(56) References Cited

U.S. PATENT DOCUMENTS 6,345,162 B1 * 2/2002 Ozawa et al. ..... 399/175
6,421,512 B2 * 7/2002 Watanabe et al. ..... 399/176
6,611,668 B2 * 8/2003 Watanabe et al. ..... 399/174
6,754,461 B2 * 6/2004 Hoshi et al. ..... 399/175
6,807,384 B2 * 10/2004 Okubo et al. ..... 399/50
6,963,707 B2 * 11/2005 Kinoshita et al.
6,996,355 B2 * 2/2006 Watanabe
7,286,788 B2 * 10/2007 Kinoshita et al.
7,395,011 B2 * 7/2008 Tanaka ..... 399/175
7,469,109 B2 * 12/2008 Shibuya ..... 399/50
2004/0013438 A1 * 1/2004 Watanabe et al. ..... 399/50

FOREIGN PATENT DOCUMENTS

JP 10-048916 2/1998
JP 2005-215321 11/2005
JP 2005-331846 12/2005

* cited by examiner

*Primary Examiner*—Susan S Lee
(74) *Attorney, Agent, or Firm*—Hogan & Hartson LLP

(57) ABSTRACT

A charger includes: a charging brush which is rotatably provided and is brought into contact with an image carrier to charge the surface of the image carrier; a charging roller which is brought into contact with the image carrier at a portion on the downstream side relative to the charging brush in the rotational direction of the image carrier to charge the surface of the image carrier; and a controller which controls voltages applied to the charging brush and charging roller, wherein the controller controls voltages applied to the charging brush and charging roller such that one-fifth of the absolute value of a charging brush current flowing between the image carrier and charging brush is lower than the absolute value of a charging roller current flowing between the image carrier and charging roller.

4 Claims, 9 Drawing Sheets

CHARGER, IMAGE FORMING APPARATUS, AND CHARGE CONTROL METHOD

CROSS-REFERENCE TO RELATED APPLICATIONS

This application is based upon and claims the benefit of priority from prior Japanese Patent Application No. 2006-334498, filed Dec. 12, 2006, the entire content of which is incorporated herein by reference.

BACKGROUND OF THE INVENTION

1. Field of the Invention

The present invention relates to a charger for charging an image carrier, an image forming apparatus of electrophotographic type incorporating the charger, and a charge control method for controlling charge of the image carrier.

2. Description of the Related Art

In a conventional image forming apparatus including an electrophotographic machine, such as an electrostatic copier, a printer, and facsimile, an image is formed as follows. First, after the surface of a photoconductor is uniformly charged by a contact charger, an electrostatic latent image is formed on the surface of the photoconductor by an exposure unit. Then, the electrostatic latent image is developed by a developing unit into a toner image and transferred directly or through an intermediate transfer member onto a transfer material such as a paper by a transfer unit. Finally, the toner image on the transfer medium is fixed by a fixing unit.

There is known, as a conventional image forming apparatus, one that brings a charging brush (primary charging member) into contact with a photoconductor to perform primary charge and then brings a charging roller which is provided on the downstream side relative to the charging brush in the rotational direction of the photoconductor into contact with the photoconductor to perform secondary charge so as to uniformly and satisfactorily charge the surface of the photoconductor (see, e.g., JP-A-2005-215321). The charger of this image forming apparatus uses the charging roller to eliminate irregular charge occurring when the charging member provided on the upstream side in the rotational direction of the photoconductor is used to charge the surface of the photoconductor, thereby achieving uniform charge of the photoconductor.

However, in the charger disclosed in JP-A-2005-215321, when the charging brush is used for a long time, impurities such as toner are adhered to or between brush bristles. This deteriorates charging efficiency of the charging brush. In order to cope with this problem, a voltage higher than a voltage required to charge an image carrier for image formation is applied to the charging brush. However, in this case, a large amount of current flows between the image carrier and charging brush, inducing an electric stress at the photosensitive layer of the image carrier. This reduces the film thickness of the photosensitive layer of the image carrier. In this case, contacting state of the brush bristles of the charging brush with the image carrier varies between the brush bristles. Accordingly, the magnitude of the reduction in the film thickness of the photosensitive layer of the image carrier varies in the axial direction of the image carrier. Further, in charging of the image carrier by double-contact charge using the charging brush and charging roller which are both brought into contact with the image carrier, the film thickness of the photosensitive layer of the image carrier is reduced also in accordance with the increase in the number of copies of image outputs.

The above reduction in the film thickness of the photosensitive member of the image carrier and variation in the magnitude of the reduction prevents the irregular charge resulting from primary charge from being satisfactorily eliminated by secondary charge using the charging roller. Therefore, the absolute value of the surface potential of the photosensitive layer may be reduced to a value lower than the absolute value of a preset image writing potential in some position in the axial direction on the image carrier. When the absolute value of the surface potential of the photosensitive layer 2*a* is reduced to a value lower than the absolute value of a preset image writing potential as described above, the relevant part is unsatisfactorily charged and appears on a print image as vertical lines to deteriorate image quality.

SUMMARY OF THE INVENTION

An object of the present invention is to provide a charger, image formation apparatus, and charge control method capable of effectively preventing occurrence of the vertical lines in the case where contact charge is performed for the image carrier using the charging brush and charging roller under constant current control.

In order to achieve the above object, according to the present invention, a relationship between the charging brush current $Ia_1$ (μA) and charging roller current $Ia_2$ (μA) is so set as to satisfy $|Ia_1|/5<|Ia_2|$. This prevents the flow of an excessive charging brush current $Ia_1$ (μA). Thus, it is possible to suppress a reduction in the thickness of the photosensitive layer of the image carrier which is caused due to the flow of an excessive charging brush current $Ia_1$ (μA). As described above, it is possible to maintain the absolute value of the surface potential of the photosensitive layer at a higher level than the absolute value of the image writing potential over a long period of time, thereby achieving stable and satisfactory charge operation. Further, the charging roller current $Ia_2$ (μA) can be controlled in association with the charging brush current $Ia_1$ (μA), so that even if the film thickness of the photosensitive layer of the image carrier is reduced, it is possible to prevent unsatisfactory charge due to poor uniformity. As a result, occurrence of vertical lines in print images can be prevented, thereby obtaining a high quality image.

Further, the absolute value of the charging brush current $Ia_1$ (μA) is increased when the rotation number of the image carrier has reached a preset specified rotation number. Thus, even if the film thickness of the photosensitive layer of the image carrier is reduced to some degree due to a long-time use of the image forming apparatus, it is possible to maintain the absolute value of the surface potential of the photosensitive layer at a higher level than the absolute value of the image writing potential, thereby achieving stable and satisfactory charge operation. As a result, occurrence of vertical lines in print images can be prevented, thereby obtaining a high quality image.

BRIEF DESCRIPTION OF THE DRAWINGS

The invention will be described with reference to the accompanying drawings, wherein like numbers reference like elements.

DESCRIPTION OF EXEMPLARY EMBODIMENTS

A preferred embodiment of the present invention will be described below with reference to the accompanying drawings.

Figure 1:
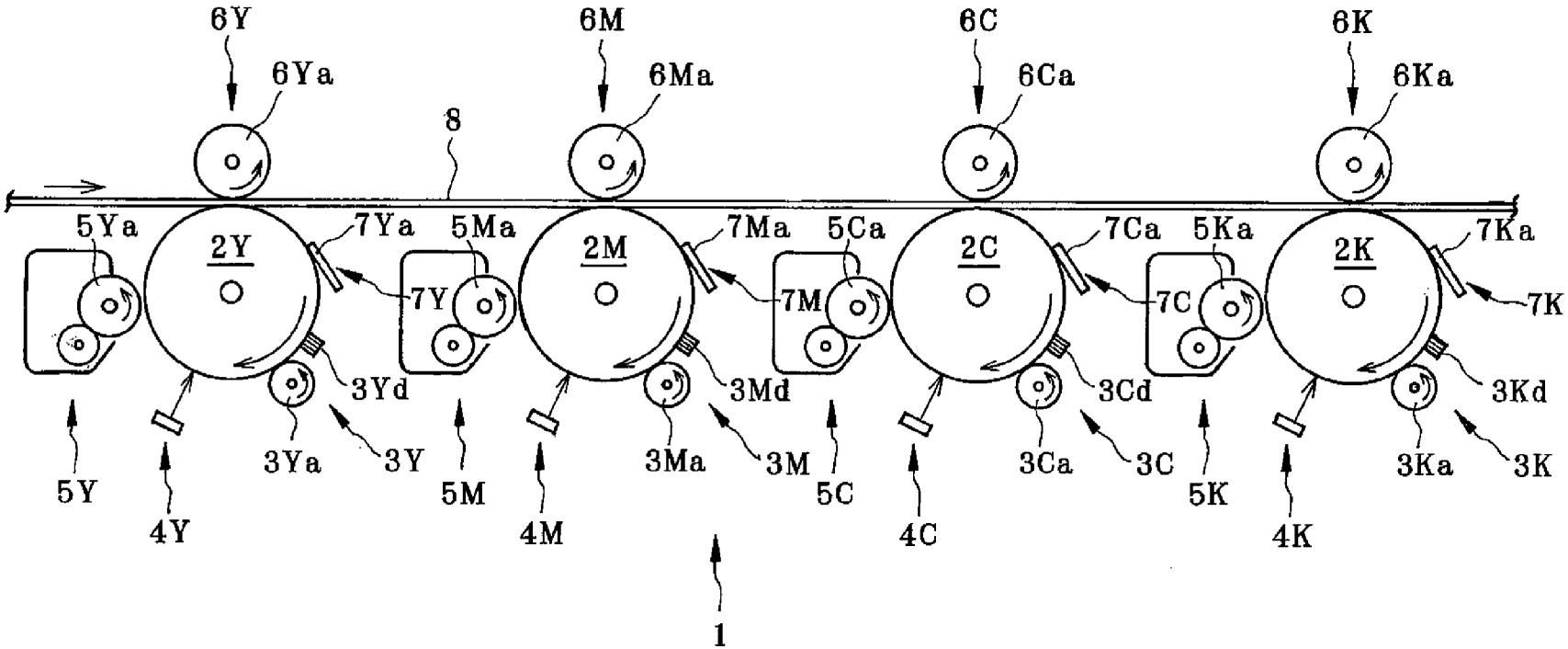
FIG. 1 is a view schematically and partially showing an example of an embodiment of an image forming apparatus according to the present invention.

FIG. 1 is a view schematically and partially showing an example of an embodiment of an image forming apparatus according to the present invention.

As shown in FIG. 1, an image forming apparatus 1 is constituted as a full color tandem type image forming apparatus having toner image forming units of yellow (Y), magenta (M), cyan (C), and black (K). The image forming apparatus 1 includes: image carriers (e.g., photoconductor drums) 2Y, 2M, 2C, 2K which are configured to form electrostatic latent images and toner images of respective colors; chargers 3Y, 3M, 3C, 3K which are sequentially disposed at positions opposite to the image carriers 2Y, 2M, 2C, 2K in this order from the upstream side in the rotational direction a of the image carriers 2Y, 2M, 2C, 2K and which are configured to charge the respective image carriers 2Y, 2M, 2C, 2K; image writing units 4Y, 4M, 4C, 4K which are configured to write electrostatic latent images on the respective image carriers 2Y, 2M, 2C, 2K; developing units 5Y, 5M, 5C, 5K which are configured to develop the electrostatic latent images on the respective image carriers 2Y, 2M, 2C, 2K using toner (developing powder) of respective colors to form toner images; primary transfer units 6Y, 6M, 6C, 6K which are configured to primary transfer the toner images on the respective image carriers 2Y, 2M, 2C, 2K; and cleaners 7Y, 7M, 7C, 7K which are configured to clean the respective image carriers 2Y, 2M, 2C, 2K.

The image carriers 2Y, 2M, 2C, 2K for respective colors Y, M, C, K have the same configurations. The same is applied to the chargers 3Y, 3M, 3C, 3K, image writing units 4Y, 4M, 4C, 4K, developing units 5Y, 5M, 5C, 5K, primary transfer units 6Y, 6M, 6C, 6K, and cleaners 7Y, 7M, 7C, 7K.

Figure 2:
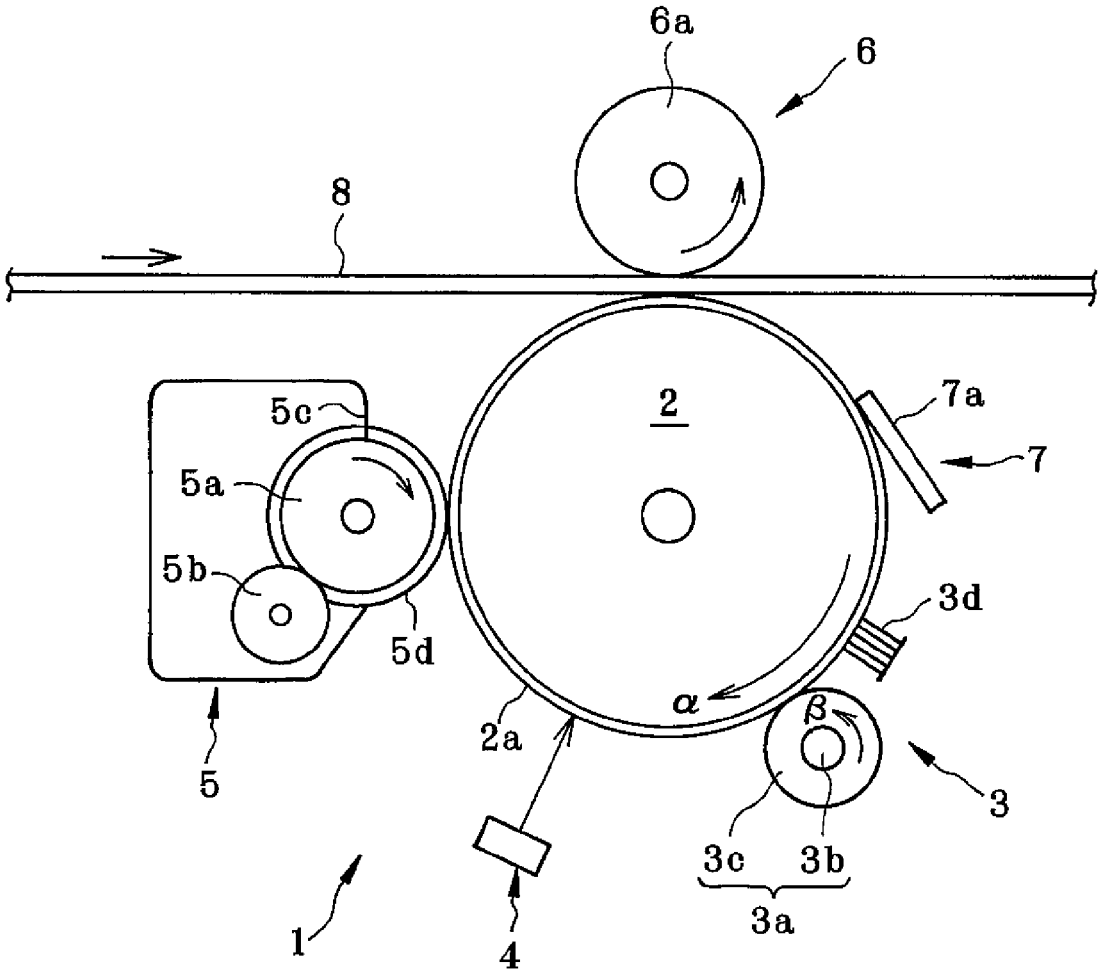
FIG. 2 is a view for explaining units provided for each color in the image formation apparatus of FIG. 1, the units provided for respective four colors having the same configuration as each other.

FIG. 2 is a view for explaining the above-mentioned units provided for each color. As described above, the units provided for respective four colors have the same configuration as one another. Note that, in FIG. 2, symbols Y, M, C, K are omitted.

As shown in FIG. 2, a photosensitive layer 2*a* having a predetermined thickness is formed on the peripheral surface of the image carrier 2. As described later, an electrostatic latent image is written by the image writing unit 4 on the surface of the photosensitive layer 2*a* charged by the charger 3.

The charger 3 includes a charging roller (CR) 3*a* (secondary charging member) for charging the photosensitive layer 2*a* of the image carrier 2 and a charging brush (CB) 3*d* (primary charging member) for charging the photosensitive layer 2*a* of the image carrier 2. The charging brush 3*d* is disposed on the upstream side relative to the charging roller 3*a* in the rotational direction α of the image carrier 2. The charging roller 3*a* is brought into contact with the surface of the photosensitive layer 2*a* of the image carrier 2 and rotated in the direction β (counterclockwise direction in FIG. 1) opposite to the rotational direction α of the image carrier 2.

The charging roller 3*a* may be a known one. That is, the charging roller 3*a* can be produced by a method disclosed in, e.g., JP-A-10-48916. The charging roller 3*a* is constituted by forming a cylindrical-shaped conductive elastomer layer 3*c*, such as a conductive rubber, whose superficial portion is made of a resistive layer having a gradient surface structure, on a metallic shaft 3*b* made of stainless. The conductive elastomer layer 3*c* has, throughout the axial direction thereof, a constant outer diameter and a constant electric resistance value.

The following is a production method of an example of the charging roller 3*a* having the conductive elastomer layer 3*c*. Epichlorohydrin rubber (Epichlomer CG-102, product of Daiso) (100 parts), sodium trifluoroacetate serving as a conductive material, zinc oxide (ZnO), and 2-mercaptoimidazoline (Accel-22) (2 parts) serving as a vulcanizing agent were kneaded by means of a roll mixer, and the kneaded product was press-formed on the surface of a metallic shaft (diameter 6 mm). The thus-coated shaft was polished, to thereby adjust the diameter to 12 mm, producing a roller in which a conductive rubber elastic member is formed on the surface of the shaft. In this case, additive amounts of sodium trifluoroacetate and zinc oxide (ZnO) are arbitrarily controlled to obtain five charging rollers 3*a* having different resistance values. Respective resistance values of the conductive elastomer layers 3*c* of the five charging roller (1) to (5) are shown in Table 1.

TABLE 1

| Roller | CR resistance value (Ω) | | |
|---|---|---|---|
| number | 10° C. | 23° C. | 35° C. |
| (1) | $3.0 \times 10^{10}$ | $1.6 \times 10^{7}$ | $2.4 \times 10^{6}$ |
| (2) | $4.0 \times 10^{8}$ | $3.7 \times 10^{6}$ | $6.8 \times 10^{5}$ |
| (3) | $6.9 \times 10^{7}$ | $1.5 \times 10^{6}$ | $3.5 \times 10^{5}$ |
| (4) | $1.4 \times 10^{7}$ | $4.5 \times 10^{5}$ | $1.1 \times 10^{5}$ |
| (5) | $3.0 \times 10^{5}$ | $6.0 \times 10^{4}$ | $3.0 \times 10^{4}$ |

As shown in Table 1, the resistance value of the charging roller (1) is $3.0\times10^{10}\Omega$ at a comparatively low temperature of 10° C., $1.6\times10^{7}\Omega$ at a room temperature of 23° C., and $2.4\times10^{6}\Omega$ at a comparatively high temperature of 35° C. The resistance value of the charging roller (2) is $4.0\times10^{8}\Omega$ at 10° C., $3.7\times10^{6}\Omega$ at 23° C., and $6.8\times10^{5}\Omega$ at 35° C. The resistance value of the charging roller (3) is $6.9\times10^{7}\Omega$ at 10° C., $1.5\times10^{6}\Omega$ at 23° C., and $3.5\times10^{5}\Omega$ at 35° C. The resistance value of the charging roller (4) is $1.4\times10^{7}\Omega$ at 10° C., $4.5\times10^{5}\Omega$ at 23° C., and $1.1\times10^{5}\Omega$ at 35° C. The resistance value of the charging roller (5) is $3.0\times10^{5}\Omega$ at 10° C., $6.0\times10^{4}\Omega$ at 23° C., and $3.0\times10^{4}\Omega$ at 35° C.

Figure 3:
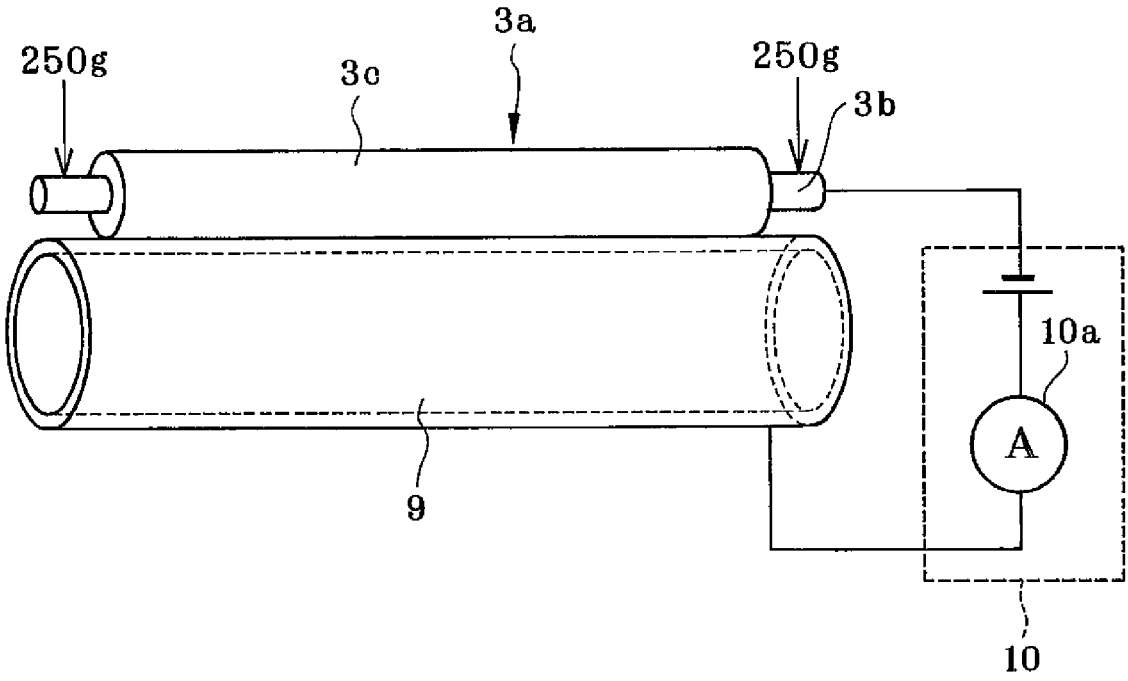
FIG. 3 is a view explaining a method for measuring the resistance value of a charging roller.

A method of measuring the resistance value of each charging roller (CR) will be described. As shown in FIG. 3, the charging roller (CR) 3*a* to be measured is placed on an aluminum pipe 9 used to constitute the photoconductor drum 2. The metallic shaft 3*b* of the charging roller (CR) 3*a* and aluminum pipe 9 are electrically connected to each other through a constant voltage supply 10 (R8340A manufactured by Advantest Co., Ltd.). A load of 250 g is applied to both ends of the metallic shaft 3*b* of the charging roller (CR) 3*a* in such a manner that the charging roller (CR) 3*a* is brought into pressure contact with the aluminum pipe 9. Further, aluminum pipe 9 is rotated at a rotation speed of 5 rpm. In this state, a voltage of 160 V is applied from the constant voltage supply 10, and a value of the current flowing through the constant voltage supply 10 is read by an ammeter 10*a*. Finally, based on the read current value and voltage, resistance value R is calculated according to V=IR (V: voltage, I: current, R: resistance).

The charging brush 3*d* is constituted as a scrubbing brush having a plurality of bristles and supported by a not-shown brush supporting member. The brush supporting member is fixed to an apparatus body and, accordingly, the charging brush 3*d* is fixed to the apparatus body. The leading ends of the brush bristles are brought into contact with the peripheral surface of the photosensitive layer 2*a* of the photoconductor 2. The charging brush 3*d* may also be a known one. An example of the charging brush 3*d* is shown in Table 2.

TABLE 2

| | Material | Fineness | Density | Original yarn resistance | Pile length | Dimension |
|---|---|---|---|---|---|---|
| Brush 1 | 6 Nylon | 220T/96F | 240 kf/inch$^2$ | 7.1 LogΩ | 5 mm | 300 mm × 5 mm × 5 mm |
| Brush 2 | 6 Nylon | 330T/48F | 80 kf/inch$^2$ | 9.3 LogΩ | 5 mm | 300 mm × 5 mm × 5 mm |

As shown in Table 2, the bristles of the brush 1 which is an example of the charging brush 3*d* are made of 6 nylon and having a fineness of 220T/96F, density of 240 kf/inch$^2$, original yarn resistance of 7.1 Log Ω, and pile length of 5 mm. The brush 1 has a length (in the axial direction of the photoconductor 2) of 300 mm, width of 5 mm, and height of 5 mm. The bristles of the brush 2 which is another example of the charging brush 3*d* are made of 6 nylon and having a fineness of 330T/48F, density of 80 kf/inch$^2$, original yarn resistance of 9.3 Log Ω, and pile length of 5 mm. The brush 2 has a length (in the axial direction of the photoconductor 2) of 300 mm, width of 5 mm, and height of 5 mm. The brushes 1 and 2 are manufactured by Toeisangyo Co., Ltd.

Figure 4:
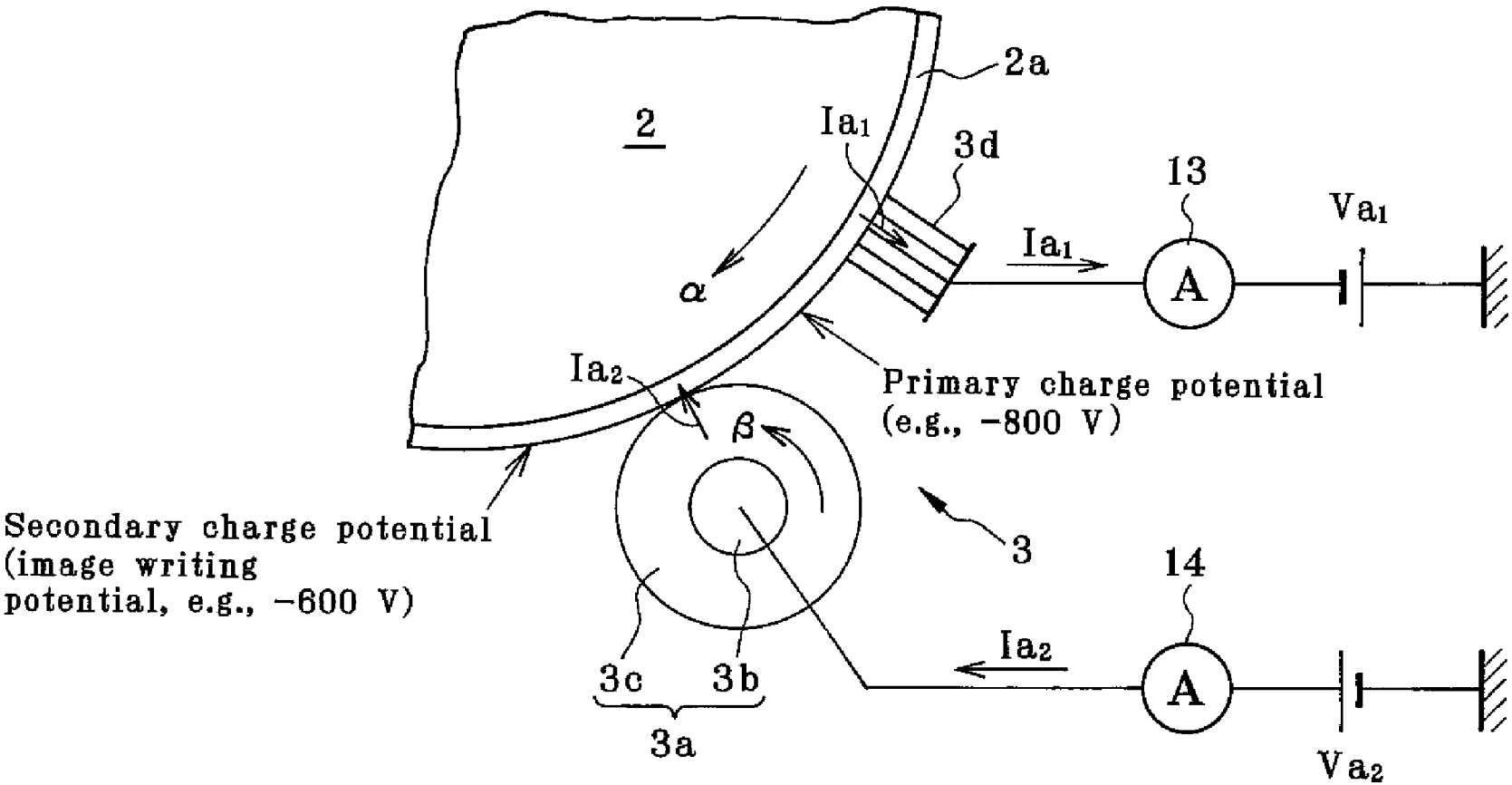
FIG. 4 is a view explaining voltage application to primary and secondary charging members under a constant current control.

Assume that the image carrier 2 is negatively charged by a DC voltage in the image forming apparatus 1 of this example. In this case, as shown in FIG. 4, a negative voltage $-Va_1$ (V) whose absolute value is higher than the absolute value of the discharge start voltage (−V) between the charging brush 3*d* and image carrier 2 is applied to the charging brush 3*d*, as shown in FIG. 4. As a result, the photosensitive layer 2*a* of the image carrier 2 is negatively charged at a primary charge potential (e.g., −800 V) by the charging brush 3*d* (primary charge). On the other hand, a negative voltage $-Va_2$ (V) or a positive voltage $+Va_2$ (V) whose absolute value is lower than the absolute value of the discharge start voltage (−V) between the charging roller 3*a* and image carrier 2 is applied to the charging roller 3*a*. As a result, the photosensitive layer 2*a* of the image carrier 2 is uniformly charged by the charging roller 3*a* (secondary charge). As described above, in the image forming apparatus 1 of this example, double-contact charge (W-charge) of the image carrier 2 is performed by the charging brush 3*d* and charging roller 3*a*. Consequently, the surface of the photosensitive layer 2*a* of the image carrier 2 is uniformly charged at an image writing potential (e.g., −600 V) that has been preset for image writing operation.

Figure 5:
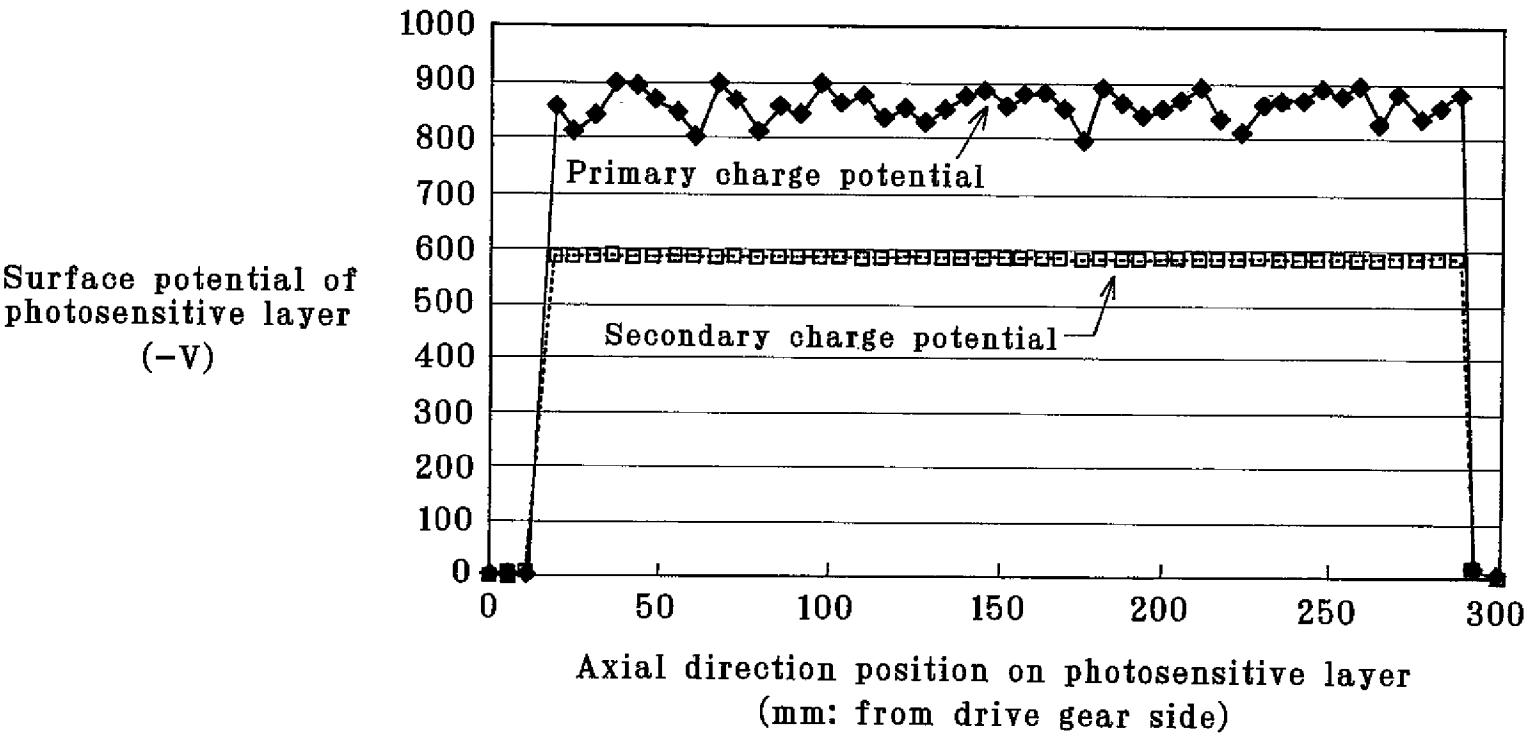
FIG. 5 is a view showing charge potential values at points in the axial direction on an image carrier.

FIG. 5 is a view showing the surface potential of the image carrier by the W-charge.

As shown in FIG. 5, in this W-charge operation, when the photosensitive layer 2*a* of the image carrier 2 is primary charged by the charging brush 3*d*, the primary charge potential of the photosensitive layer 2*a* varies between −800 V and −900 V depending on the position on the image carrier 2 in the axial direction thereof. The reason for the occurrence of this variation may be that a large number of bristles of the charging brush 3*d* are not uniformly brought into press contact with the photosensitive layer 2*a* of the image carrier 2. In this state, when the photosensitive layer 2*a* of the image carrier 2 is secondary charged by the charging roller 3*a*, the surface potential of the photosensitive layer 2*a* is uniformly set at an image writing potential of about −600 V irrespective of the position on the image carrier 2 in the axial direction thereof.

The image writing unit 4 writes an electrostatic latent image on the image carrier 2 charged by the charger 3 using a laser light or the like. The developing unit 5 includes a developing roller 5*a*, a toner supply roller 5*b*, and a toner layer thickness regulation member 5*c*. The developing roller 5*a* has, at its both end portions, ring members 5*d* (in FIG. 2, only one side ring member 5*d* is shown). The ring member 5*d* serves as a member for regulating a distance between the shafts of the developing roller and image carrier. That is, the contact of the ring member 5*d* with the peripheral surface of the image carrier 2 regulates the distance between the shaft center of the developing roller 5*a* and shaft center of the image carrier 2. As a result, a predetermined development gap is provided between the peripheral surface of the developing roller 5*a* and peripheral surface of the image carrier 2.

Not-shown toner (developer) is supplied by the toner supply roller 5*b* onto the developing roller 5*a* and, then, the toner on the developing roller 5*a* is conveyed to the image carrier 2 while the thickness thereof is regulated by the toner layer thickness regulation member 5*c*. After that, the electrostatic latent image on the image carrier 2 is subjected to non-contact jumping development, whereby a toner image is formed on the image carrier 2.

The primary transfer unit 6 has a primary transfer roller 6*a*, by which the toner image on the image carrier 2 is transferred onto an intermediate transfer medium 8 which is, e.g., an intermediate transfer belt.

The cleaning unit 7 has a cleaning blade 7*a* made of an elastic material such as a rubber. This cleaning blade 7*a* is attached to the apparatus body through a not-shown blade supporting member. The cleaning blade 7*a* is always brought into press-contact with the peripheral surface of the image carrier 2. The peripheral surface of the image carrier 2 is thus cleaned by the cleaning blade 7*a*, whereby the residual toner on the image carrier 2 after transfer operation is removed and collected in a not-shown toner collector.

Although not shown, the image forming apparatus 1 further includes at least a known secondary transfer unit for secondary transferring the toner image that has been transferred onto the intermediate transfer medium 8 onto a transfer material such as a paper and a known fixing unit for heat-and-pressure fixing the toner image that has been secondary transferred onto the transfer material.

An image formation operation of the image forming apparatus 1 will next be described with reference to FIG. 1. The following description is made with the color symbols Y, M, C, K given to the reference numerals of the corresponding components provided for respective colors.

In FIG. 1, the image carrier 2Y for yellow (Y) is primary charged by the charging brush 3Yd and, then, uniformly secondary charged by the charging roller 3Ya. Subsequently, after an electrostatic latent image is written onto the image carrier 2Y by the image writing unit 4Y, this electrostatic latent image is developed by toner conveyed by the developing roller 5Ya of the developing unit 5Y. In this manner, a toner image of yellow (Y) is formed on the image carrier 2Y. With predetermined time lags, toner images of the other colors M, C, K are sequentially formed onto the image carriers 2M, 2C, 2K.

The toner image of yellow (Y) on the image carrier 2Y is primary transferred onto the intermediate transfer medium 8 by the primary transfer unit 6Y and, then, the toner image of yellow (Y) on the intermediate transfer medium 8 is conveyed toward the primary transfer unit 6M. Then, a toner image of magenta (M) on the image carrier 2M is primary transferred, by the primary transfer unit 6M, onto a predetermined position on the intermediate transfer medium 8 in a superimposed manner on the toner image of yellow (Y). The toner image on the intermediate transfer medium 8 obtained by superimposing the toner images of yellow (Y) and magenta (M) is conveyed toward the primary transfer unit 6C of cyan (C). Then, a toner image of cyan (C) on the image carrier 2C is primary transferred, by the primary transfer unit 6C, onto a predetermined position on the intermediate transfer medium 8 in a superimposed manner on the toner image of yellow (Y) and magenta (M). Subsequently, the toner image on the intermediate transfer medium 8 obtained by superimposing the toner images of yellow (Y), magenta (M), and cyan (C) is conveyed toward the primary transfer unit 6K of black (K). Then, a toner image of black (K) on the image carrier 2K is primary transferred, by the primary transfer unit 6K, onto a predetermined position on the intermediate transfer medium 8 in a superimposed manner on the toner image of yellow (Y), magenta (M), and cyan (C). In this manner, a full color toner image is formed on the intermediate transfer medium 8.

The full color toner image on the intermediate transfer medium 8 is secondary transferred onto a transfer material such as a paper by the secondary transfer unit and, then, the full color toner image on the transfer material is heat-and-pressure fixed by the fixing unit. In this manner, a full color toner image is formed and fixed on the transfer material.

When the charging brush 3*d* is used as the primary charging member, impurities such as toner are adhered to brush bristles, as described above, so that charging efficiency of the charging brush 3*d* is deteriorated. In order to cope with this problem, a voltage higher than a voltage required to charge the image carrier 2 for image formation is applied to the charging brush 3*d*. However, in this case, a large amount of current flows between the image carrier 2 and charging brush 3*d*, inducing an electric stress at the photosensitive layer 2*a* of the image carrier 2. This reduces the film thickness of the photosensitive layer 2*a* of the image carrier 2. In this case, contacting state of the brush bristles of the charging brush 3*d* with the image carrier 2 varies between the brush bristles. Accordingly, the magnitude of the reduction in the film thickness of the photosensitive layer 2*a* varies in the axial direction of the image carrier.

Further, in charging of the image carrier 2 by double-contact charge using the charging brush 3*d* and charging roller 3*a* which are both brought into contact with the image carrier 2, the film thickness of the photosensitive layer 2*a* of the image carrier 2 is reduced also in accordance with the increase in the number of copies of image outputs.

Figure 6:
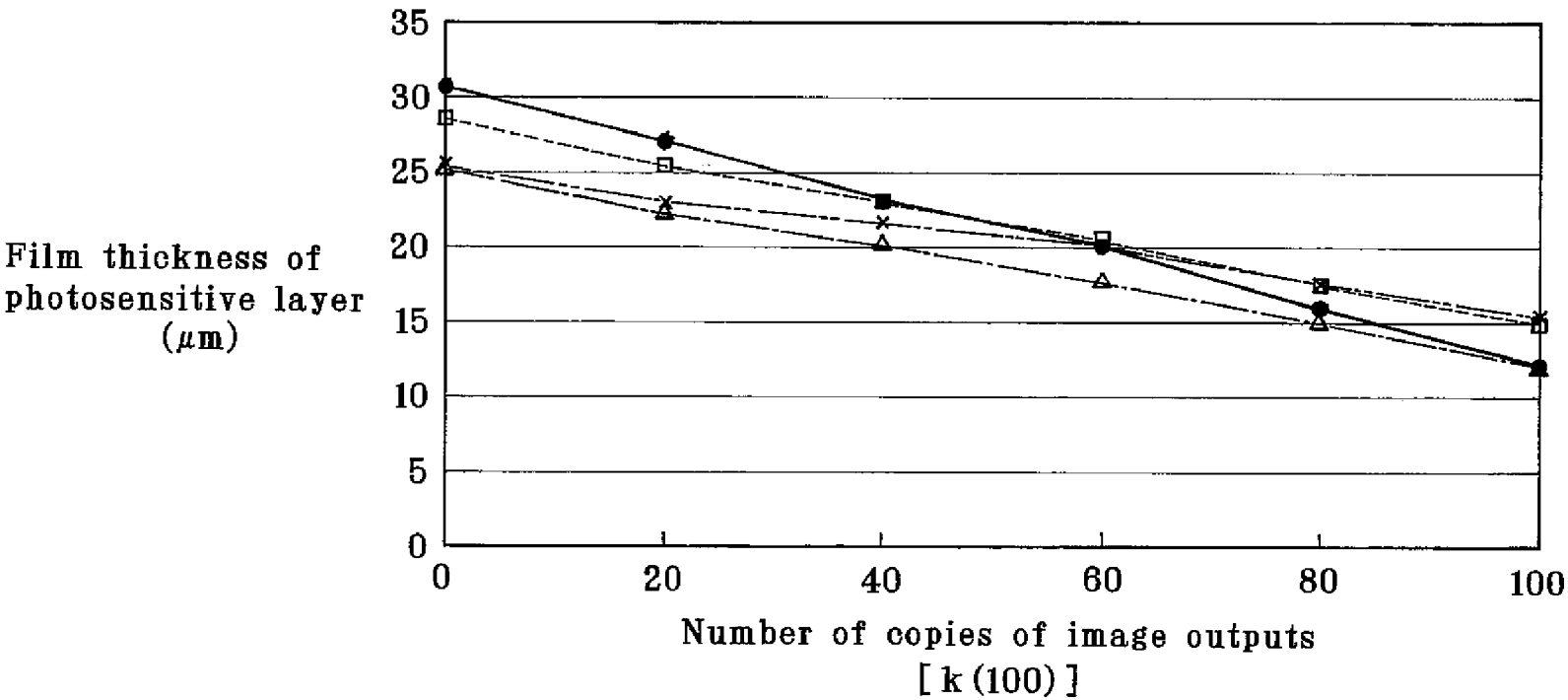
FIG. 6 is a view showing a relationship between a number of copies of image outputs and film thickness of a photosensitive layer of the image carrier.

FIG. 6 is a view showing a relationship between a number of copies of image outputs and film thickness of the photosensitive layer 2*a* which is obtained by experiments to be described later in which four photoconductor drums are used as the image carrier 2. As shown in FIG. 6, the film thicknesses of the photosensitive layers 2*a* of all four photoconductor drums are reduced in accordance with the increase in the number of copies of image outputs. The magnitude of the reduction in the film thickness of the photosensitive layer 2*a* varies in the axial direction of the image carrier 2.

When the magnitude of the reduction in the film thickness of the photosensitive layer 2*a* varies in accordance with the reduction in the film thickness of the photosensitive layer 2*a*, the absolute value of the surface potential of the photosensitive layer 2*a* after the secondary charge is performed using the charging roller 3*a* may become lower than the absolute value of a present image writing potential (e.g., −600 V) in some position in the axial direction on the image carrier 2 in some cases. When the absolute value of the surface potential of the photosensitive layer 2*a* is reduced to a value lower than the absolute value of the image writing potential as described above, the relevant part is unsatisfactorily charged and appears on a print image as vertical lines to deteriorate image quality.

In order to cope with this, the charger 3 of this example charges the image carrier 2 by constant current control so that a predetermined relationship is established between a primary charging member current (charging brush current) $Ia_1$ (μA) flowing between the image carrier 2 and charging brush 3*d* and a secondary charging member current (charging roller current) $Ia_2$ (μA) flowing between the image carrier 2 and charging roller 3*a*. More specifically, in the charger 3 of this example, a setting is made such that one-fifth of the absolute value of the charging brush current $Ia_1$ (μA) is lower than the absolute value of the charging roller current $Ia_2$ (μA) ($|Ia_1|/5<|Ia_2|$). In the present invention, the charging brush current $Ia_1$ (μA) flowing from the image carrier 2 to charging brush 3*d* is defined as positive (+), and that flowing from the charging brush 3*d* to image carrier 2 is defined as negative (−). Similarly, the charging roller current $Ia_2$ (μA) flowing from the charging roller 3*a* to image carrier 2 is defined as positive (+), and that flowing from the image carrier 2 to charging roller 3*a* is defined as negative (−). The above charging brush current $Ia_1$(μA) and charging roller current $Ia_2$ (μA) are set by controlling a voltage $Va_1$ (V) applied to the charging brush 3*d* and voltage $Va_2$(V) applied to the charging roller 3*a*.

Figure 7:
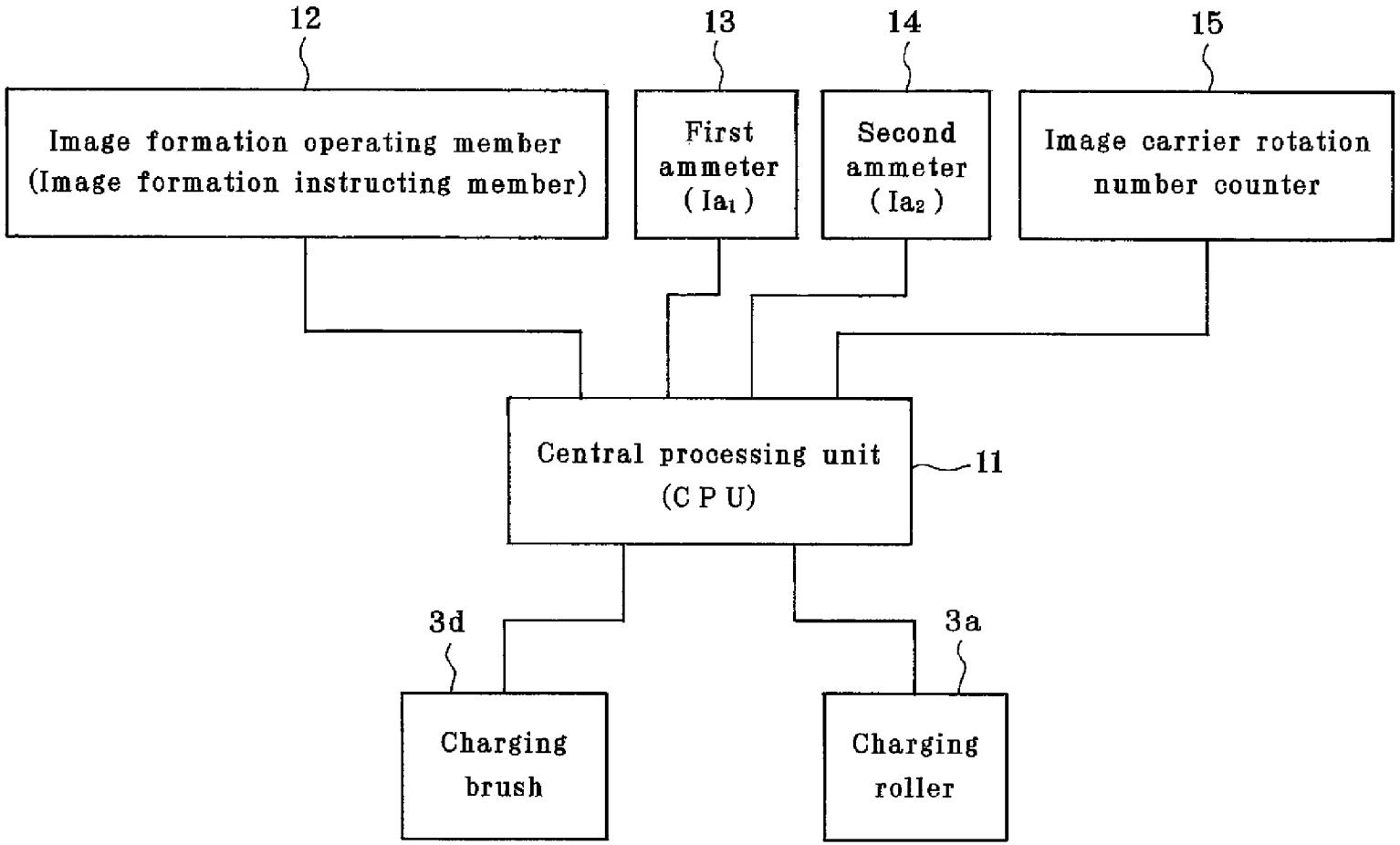
FIG. 7 is a block diagram showing a configuration for voltage application to primary and secondary charging members.

FIG. 7 is a block diagram showing a configuration for setting the charging brush current and charging roller current.

As shown in FIG. 7, in order to apply a charging voltage to the charging brush 3*d* and charging roller 3*a* and control the application voltage, the image forming apparatus 1 includes a central processing unit (CPU) 11. The CPU 11 controls the entire operation of the image forming apparatus 1 in order to perform image formation. Connected to the CPU 11 are an image formation operating member (image formation instructing member) 12, such as an operation key provided on a console panel or touch key on an operation screen, for outputting an operation instruction (image formation instruction) to allow the image forming apparatus 1 to perform an image formation operation, a first ammeter 13 for measuring the charging brush current $Ia_1$ (μA), a second ammeter 14 for measuring the charging roller current $Ia_2$ (μA), and an image carrier rotation number counter 15 for counting the number of image formation operations in the image forming apparatus 1.

When an image formation instruction signal is input from the image formation operating member 12, the CPU 11 applies a voltage $Va_1$ (V) and voltage $Va_2$ (V) to the charging brush 3*d* and charging roller 3*a* for allowing the image forming apparatus 1 to perform an image formation operation. Meanwhile, when an image formation instruction signal is input, the CPU 11 applies a voltage $Va_1$ (V) and voltage $Va_2$ (V) to the charging brush 3*d* and charging roller 3*a* for performing the charge of the image carrier 2 which is one of the image formation operations of the image forming apparatus 1. Further, a measurement signal of the charging brush current $Ia_1$ (μA) and measurement signal of the charging roller current $Ia_2$ (μA) are input from the first ammeter 13 and second ammeter 14, respectively, to the CPU 11. Then, the CPU 11 controls a voltage $-Va_1$ (V) and voltage $Va_2$ (−V or V) applied to the charging brush 3*d* and charging roller 3*a* respectively such that the relationship $|Ia_1|/5<|Ia_2|$ is established between the input charging brush current $Ia_1$(μA) and charging roller current $Ia_2$ (μA).

Further, in the image forming apparatus 1 of this example, the rotation number of the image carrier 2 is counted by the image carrier rotation number counter 15. A signal corresponding to the count value is input to the CPU 11. When the rotation number of the image carrier 2 is increased up to a preset specified rotation number by a long-time use, i.e., the number of image formation operations reaches a preset specified value, the CPU 11 determines that the film thickness of the photosensitive layer 2*a* of the image carrier 2 has been reduced to a predetermined value and increases the absolute value of the charging brush current $Ia_1$ (μA) by a certain level. That is, the CPU 11 controls the application voltage to the charging brush 3*d* such that when the rotation number of the image carrier 2 reaches a specified rotation number, i.e., the number of image formation operations reaches a specified value, the absolute value of the charging brush current $Ia_1$ (μA) is set to a preset value higher than the absolute value of the current value at that time.

Figure 8:
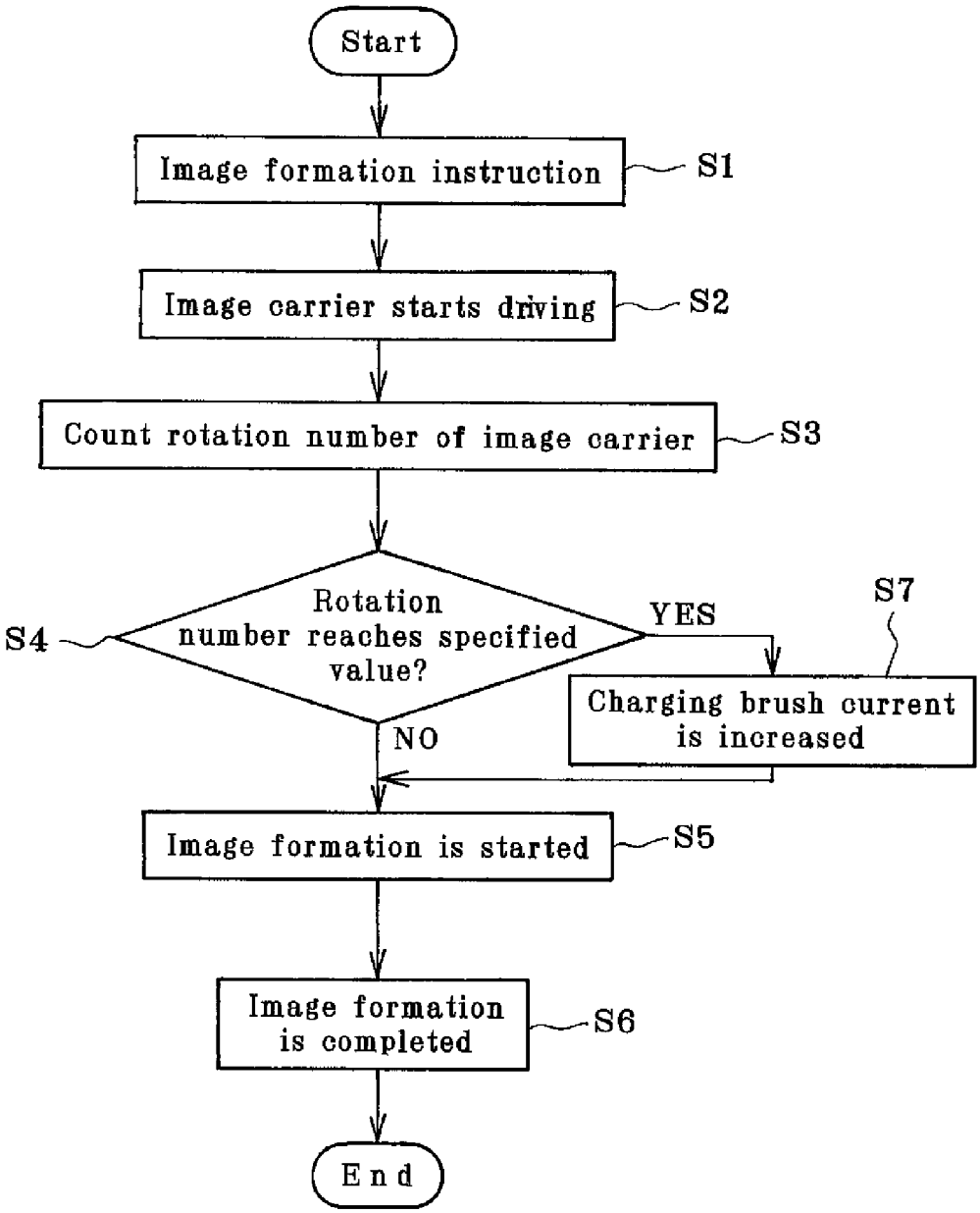
FIG. 8 is a flowchart showing a procedure of controlling a supply current to the primary charging member when the film thickness of the photosensitive layer of the image carrier has been reduced.

FIG. 8 is a flowchart showing a procedure of controlling a supply current to the charging brush in accordance with the rotation number of the image carrier.

First, when an image formation instruction is issued in step S1 in order to control a charging brush current $Ia_1$ (μA) in accordance with the rotation number of the image carrier 2, the image carrier 2 starts driving in step S2 and, then, the rotation number of the image carrier 2 is counted by the image carrier rotation number counter 15 in step S3. Subsequently, in step S4, it is determined whether the accumulated count value of the rotation number of the image carrier 2 has reached the specified value. When it is determined that the accumulated count value of the rotation number of the image carrier 2 has not reached the specified value, an image formation operation is started in step S5.

That is, a primary charging voltage $Va_1$ (−V) so controlled as to achieve a charging brush current $Ia_1$ (μA) corresponding to a set value at that time is applied to the charging brush 3*d*. Thus, the primary charge of the photosensitive layer 2*a* of the image carrier 2, which is one of the image formation operations, is performed by this charging brush 3*d*. At this time, a relationship between the charging roller current $Ia_2$ (μA) and charging brush current $Ia_1$ (μA) is so set as to satisfy $|Ia_1|/5<|Ia_2|$. Therefore, a charging voltage $Va_1$ (−V) so controlled as to achieve the charging roller current $Ia_1$ (μA) is applied to the charging roller 3*a*. Thus, the secondary charge of the photosensitive layer 2*a* of the image carrier 2, which is one of the image formation operations, is performed by this charging roller 3*a*. When the image formation operation is completed in step S6, the charge control for the photosensitive layer 2*a* of the image carrier 2 performed by controlling the charging brush current $Ia_1$ (μA) and charging roller current $Ia_2$ (μA) is completed.

It is determined, in step S4, that the accumulated count value of the rotation number of the image carrier 2 has reached the specified value, the charging brush current $Ia_1$ (μA) is increased by a predetermined level in step S7. That is, the primary charging voltage $-Va_1$ (V) is so controlled newly as to achieve the charging brush current $Ia_1$ (μA) that has been increased by a predetermined level. Further, the charging roller current $Ia_2$ (μA) is so set newly as to satisfy $|Ia_1|/5<|Ia_2|$ with respect to the charging brush current $Ia_1$ (μA) that has been increased by a predetermined level. Then, the charging voltage $Va_2$ (−V or V) of the charging roller 3*a* is so controlled newly as to achieve the charging roller current $Ia_2$ (μA) that has newly been set. Subsequently, the flow shifts to step S5 and the processing of step S5 and subsequent steps are performed. At the starting time of the image formation operation in step S5, the newly controlled voltage $-Va_1$ (V) is applied to the charging brush 3*d* and newly controlled voltage $Va_2$ (−V or V) is applied to the charging roller 3*a*. When the image formation operation is completed in step S6, the charge control for the photosensitive layer 2*a* of the image carrier 2 under the above current control is completed.

According to the image forming apparatus 1 of this example, a relationship between the charging brush current $Ia_1$ (μA) and charging roller current $Ia_2$ (μA) is so set as to satisfy $|Ia_1|/5<|Ia_2|$. This prevents the flow of an excessive charging brush current $Ia_1$ (μA). Thus, it is possible to suppress a reduction in the thickness of the photosensitive layer 2*a* of the image carrier 2 which is caused due to the flow of an excessive charging brush current $Ia_1$(μA). As described above, it is possible to maintain the absolute value of the surface potential of the photosensitive layer 2*a* at a higher level than the absolute value of the image writing potential over a long period of time, thereby achieving stable and satisfactory charge operation. Further, the charging roller current $Ia_2$ (μA) can be controlled in association with the charging brush current $Ia_1$ (μA), so that even if the film thickness of the photosensitive layer 2*a* of the image carrier 2 is reduced, it is possible to prevent unsatisfactory charge due to poor uniformity. As a result, occurrence of vertical lines in print images can be prevented, thereby obtaining a high quality image.

Further, the absolute value of the charging brush current $Ia_1$ (μA) is increased when the rotation number of the image carrier 2 has reached a preset specified rotation number. Thus, even if the film thickness of the photosensitive layer 2*a* of the image carrier 2 is reduced to some degree due to a long-time use of the image forming apparatus 1, it is possible to maintain the absolute value of the surface potential of the photosensitive layer 2*a* at a higher level than the absolute value of the image writing potential, thereby achieving stable and satisfactory charge operation. As a result, occurrence of vertical lines in print images can be prevented, thereby obtaining a high quality image.

Next, a description will be given of experiments made for confirming the advantage obtained by the present invention.

(Experimental Apparatus)

As an experimental apparatus, a commercially available printer, LP-9000C, manufactured by Seiko Epson Corporation was used. A charger of a photoconductor unit for LP-9000C was partially modified so that the charging brush 3*d* (as primary charging member) and charging roller 3*a* (as secondary charging member) can be attached thereto. The charging brushes 1 and 2 shown in Table 2 were used as the charging brush 3*d*, and charging rollers (3) and (4) taken as an example in Table 1 were used as the charging roller 3*a*. Further, the configuration was made such that a voltage can externally be applied to the charging brush 3*d* and charging roller 3*a* and voltage control can externally be made. Voltages were applied to the charging brush 3*d* and charging roller 3*a* respectively such that the charge of the image carrier 2 by the charging brush 3*d* and charging roller 3*a* was performed under constant current control. To this end, the two ammeters 13 and 14 shown in FIG. 4 were provided. Other components including a photoconductor drum (image carrier), a cleaning blade, an optical writing unit, a development unit (including genuine toner), a transfer unit (including intermediate transfer belt), and a fixing unit were original parts of the printer LP-9000C. In the experiments, as shown in Table 3, an image carrier 2 having a photosensitive layer film thickness (OPC film thickness) of 26 μm was used in Examples 1 to 6 and Comparative examples 1 and 2, and image carrier 2 having a photosensitive layer film thickness (OPC film thickness) of 15 μm was used in Examples 7 to 10 and Comparative examples 3 to 6.

TABLE 3

| | OPC film thickness (μm) | Brush | Roller number | Ia1 (μA) | Va2 (V) | Ia2 (μA) | | Ia1/5 (μA) | Determination on vertical lines |
|---|---|---|---|---|---|---|---|---|---|
| Example 1 | 26 | Brush 1 | (3) | 66 | 80 | 30 | > | 13 | Excellent |
| Example 2 | 26 | Brush 2 | (3) | 59 | 80 | 25 | > | 12 | Excellent |
| Example 3 | 26 | Brush 1 | (4) | 54 | 80 | 20 | > | 11 | Excellent |
| Example 4 | 26 | Brush 2 | (4) | 49 | 80 | 15 | > | 10 | Excellent |
| Example 5 | 26 | Brush 1 | (3) | 46 | 80 | 12 | > | 9 | Excellent |
| Example 6 | 26 | Brush 2 | (3) | 44 | 80 | 10 | > | 9 | Good |
| Comparative example 1 | 26 | Brush 1 | (4) | 40 | 80 | 7 | < | 8 | Poor |
| Comparative example 2 | 26 | Brush 2 | (4) | 35 | 80 | 4 | < | 7 | Poor |
| Example 7 | 15 | Brush 2 | (3) | 122 | 150 | 40 | > | 24 | Excellent |
| Example 8 | 15 | Brush 1 | (3) | 118 | 150 | 35 | > | 24 | Excellent |
| Example 9 | 15 | Brush 2 | (4) | 112 | 150 | 30 | > | 22 | Excellent |
| Example 10 | 15 | Brush 1 | (4) | 106 | 150 | 25 | > | 21 | Excellent |
| Comparative example 3 | 15 | Brush 2 | (3) | 100 | 150 | 20 | = | 20 | Somewhat poor |
| Comparative example 4 | 15 | Brush 1 | (3) | 95 | 150 | 15 | < | 19 | Poor |
| Comparative example 5 | 15 | Brush 2 | (4) | 90 | 150 | 10 | < | 18 | Poor |
| Comparative example 6 | 15 | Brush 1 | (4) | 84 | 150 | 5 | < | 18 | Poor |

(Image Formation Test)

The same image formation test was carried out on Examples 1 to 10 and Comparative examples 1 to 6. That is, 1000 sheets (A4 size, regular paper) of monochrome halftone image were printed out successively under a room temperature (23° C.). After the test, the obtained images were visually confirmed to determine presence/absence of vertical lines. In the case of absence of vertical lines, it was determined that charge state was excellent or good; while in the case of presence of vertical lines, it was determined that charge state was poor or somewhat poor.

The following experimental conditions are commonly used in Examples 1 to 10 and Comparative examples 1 to 6: process speed is 210 mm/sec; peripheral speed ratio between charging roller and photoconductor drum is 1; development voltage is superimposed voltage of and DC voltage ($V_{DC}$=−200 V) and AC voltage ($V_{PP}$=1400 V, rectangular waveform having frequency f=3.0 KHz (50% duty)); and transfer voltage is +200 V.

Individual experimental conditions of the Examples 1 to 10 and Comparative examples 1 to 6 will be described below.

EXAMPLE 1

As shown in Table 3, the brush 1 was used as the charging brush 3*d* and charging roller (3) was used as the charging roller 3*a*. The voltage $Va_2$ (V) applied to the charging roller 3*a* was set at a DC voltage of +80 V at which a satisfactory result had been obtained in image density control under voltage control. Then, after +80 V was applied to the charging roller 3*a*, a current $Ia_1$ (μA) flowing from the image carrier 2 to charging brush 3*d* was monitored by the ammeter 13 and a current $Ia_1$ (μA) flowing from the charging roller 3*a* to image carrier 2 was monitored by the ammeter 14. Further, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 1, $Ia_1$ was +66 μA, and $Ia_2$ was +30 μA.

EXAMPLE 2

As shown in Table 3, the brush 2 was used as the charging brush 3*d* and charging roller (3) was used as the charging roller 3*a*. +80 V was applied to the charging roller 3*a* and, as in the case of Example 1, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 2, $Ia_1$ was +59 μA, and $Ia_2$ was +25 μA.

EXAMPLE 3

As shown in Table 3, the brush 1 was used as the charging brush 3*d* and charging roller (4) was used as the charging roller 3*a*. +80 V was applied to the charging roller 3*a* and, as in the case of Example 1, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 3, $Ia_1$ was +54 μA, and $Ia_2$ was +20 μA.

EXAMPLE 4

As shown in Table 3, the brush 2 was used as the charging brush 3*d* and charging roller (4) was used as the charging roller 3*a*. +80 V was applied to the charging roller 3*a* and, as in the case of Example 1, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 4, $Ia_1$ was +49 μA, and $Ia_2$ was +15 μA.

EXAMPLE 5

As shown in Table 3, the brush 1 was used as the charging brush 3*d* and charging roller (3) was used as the charging roller 3*a*. +80 V was applied to the charging roller 3*a* and, as in the case of Example 1, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 5, $Ia_1$ was +46 μA, and $Ia_2$ was +12 μA.

EXAMPLE 6

As shown in Table 3, the brush 2 was used as the charging brush 3*d* and charging roller (3) was used as the charging roller 3*a*. +80 V was applied to the charging roller 3*a* and, as in the case of Example 1, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 6, $Ia_1$ was +44 μA, and $Ia_2$ was +10 μA.

COMPARATIVE EXAMPLE 1

As shown in Table 3, the brush 1 was used as the charging brush 3*d* and charging roller (4) was used as the charging roller 3*a*. +80 V was applied to the charging roller 3*a*, and a negative DC voltage $-Va_1$ (V) by which a relationship between the charging brush current $Ia_1$ (μA) and charging roller current $Ia_2$ (μA) satisfies $|Ia_2|<|Ia_1|/5$ was applied to the charging brush 3*d*. In Comparative example 1, $Ia_1$ was +40 μA, and $Ia_2$ was +7 μA.

COMPARATIVE EXAMPLE 2

As shown in Table 3, the brush 2 was used as the charging brush 3*d* and charging roller (4) was used as the charging roller 3*a*. +80 V was applied to the charging roller 3*a* and, as in the case of Comparative example 1, a negative DC voltage $-Va_1$ (V) by which a relationship between the charging brush current $Ia_1$ (μA) and charging roller current $Ia_2$ (μA) satisfies $|Ia_2|<|Ia_1|/5$ was applied to the charging brush 3*d*. In Comparative example 2, $Ia_1$ was +35 μA, and $Ia_2$ was +4 μA.

EXAMPLE 7

As shown in Table 3, the brush 2 was used as the charging brush 3*d* and charging roller (3) was used as the charging roller 3*a*. The voltage $Va_2$ (V) applied to the charging roller 3*a* was set at a DC voltage of +150 V at which a satisfactory result had been obtained in image density control under voltage control. Then, after +150 V was applied to the charging roller 3*a*, a current $Ia_1$ (μA) flowing from the image carrier 2 to charging brush 3*d* was monitored by the ammeter 13 and a current $Ia_1$ (μA) flowing from the charging roller 3*a* to image carrier 2 was monitored by the ammeter 14. Further, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 7, $Ia_1$ was +122 μA, and $Ia_2$ was +40 μA.

EXAMPLE 8

As shown in Table 3, the brush 1 was used as the charging brush 3*d* and charging roller (3) was used as the charging roller 3*a*. +150 V was applied to the charging roller 3*a* and, as in the case of Example 7, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 8, $Ia_1$ was +118 μA, and $Ia_2$ was +35 μA.

EXAMPLE 9

As shown in Table 3, the brush 2 was used as the charging brush 3*d* and charging roller (4) was used as the charging roller 3*a*. +150 V was applied to the charging roller 3*a* and, as in the case of Example 7, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 9, $Ia_1$ was +112 μA, and $Ia_2$ was +30 μA.

EXAMPLE 10

As shown in Table 3, the brush 1 was used as the charging brush 3*d* and charging roller (4) was used as the charging roller 3*a*. +150 V was applied to the charging roller 3*a* and, as in the case of Example 7, a negative DC voltage $-Va_1$ (V) by which a relationship between the charging brush current $Ia_1$ (μA) and charging roller current $Ia_2$ (μA) satisfies $|Ia_2|>|Ia_1|/5$ was applied to the charging brush 3*d*. In Example 10, $Ia_1$ was +106 μA, and $Ia_2$ was +25 μA.

COMPARATIVE EXAMPLE 3

As shown in Table 3, the brush 2 was used as the charging brush 3*d* and charging roller (3) was used as the charging roller 3*a*. +150 V was applied to the charging roller 3*a*, and a negative DC voltage $-Va_1$ (V) by which a relationship between the charging brush current $Ia_1$ (μA) and charging roller current $Ia_2$ (μA) satisfies $|Ia_2|=|Ia_1|/5$ was applied to the charging brush 3*d*. In Comparative example 3, $Ia_1$ was +100 μA, and $Ia_2$ was +20 μA.

COMPARATIVE EXAMPLE 4

As shown in Table 3, the brush 1 was used as the charging brush 3*d* and charging roller (3) was used as the charging roller 3*a*. +150 V was applied to the charging roller 3*a*, and a negative DC voltage $-Va_1$ (V) by which a relationship between the charging brush current $Ia_1$ (μA) and charging roller current $Ia_2$ (μA) satisfies $|Ia_2|<|Ia_1|/5$ was applied to the charging brush 3*d*. In Comparative example 4, $Ia_1$ was +95 μA, and $Ia_2$ was +15 μA.

COMPARATIVE EXAMPLE 5

As shown in Table 3, the brush 2 was used as the charging brush 3*d* and charging roller (4) was used as the charging roller 3*a*. +150 V was applied to the charging roller 3*a*, and a negative DC voltage $-Va_1$ (V) by which a relationship between the charging brush current $Ia_1$ (μA) and charging roller current $Ia_2$ (μA) satisfies $|Ia_2|<|Ia_1|/5$ was applied to the charging brush 3*d*. In Comparative example 5, $Ia_1$ was +90 μA, and $Ia_2$ was +10 μA.

COMPARATIVE EXAMPLE 6

As shown in Table 3, the brush 1 was used as the charging brush 3*d* and charging roller (4) was used as the charging roller 3*a*. +150 V was applied to the charging roller 3*a*, and a negative DC voltage $-Va_1$ (V) by which a relationship between the charging brush current $Ia_1$ (μA) and charging roller current $Ia_2$ (μA) satisfies $|Ia_2|<|Ia_1|/5$ was applied to the charging brush 3*d*. In Comparative example 6, $Ia_1$ was +84 μA, and $Ia_2$ was +18 μA.

Figure 9:
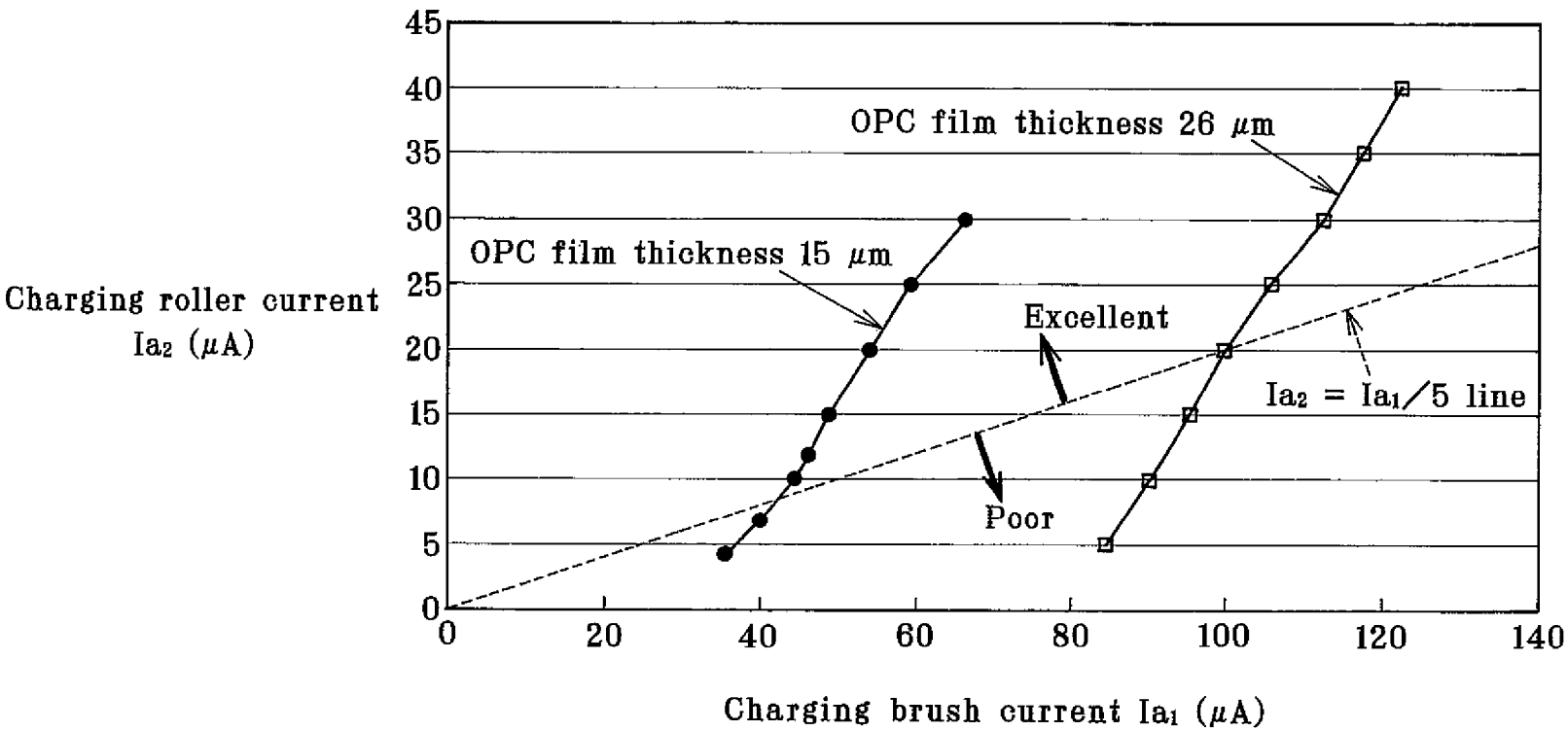
FIG. 9 is a view showing experiment results.

The experiment results are shown in Table 3 and FIG. 9. As is clear from Table 3 and FIG. 9, in the case where the OPC film thickness is 26 μm, the rating of "excellent" was achieved in Examples 1 to 5 according to the present invention and rating of "good" was achieved in Example 6 according to the present invention. That is, the vertical lines did not appear in Examples 1 to 6 and satisfactory charge state was obtained. Whereas, the vertical lines appeared and charge state became unsatisfactory in Comparative examples 1 and 2.

In the case where the OPC film thickness is 15 μm, the rating of "excellent" was achieved in Examples 7 to 10 according to the present invention. That is, the vertical lines did not appear in Examples 7 to 10 and satisfactory charge state was obtained. Whereas, some amount of the vertical lines appeared and charge state became somewhat unsatisfactory in Comparative examples 3, and vertical lines appeared and charge state became unsatisfactory in Comparative examples 4 to 6.

As a result, it was confirmed that the intended effects can be obtained according to the present invention.

Although the case where the present invention is applied to the image processing apparatus which negatively charges the image carrier 2 by means of the charger 3 at the time of image formation has been explained in the above embodiment, the present invention can also be applied to an image forming apparatus which positively charges the image carrier 2 by means of the charger 3 at the time of image formation. In this case, the magnitude relation between the absolute values of the charging brush current $Ia_1$ (μA) and charging roller current $Ia_2$ (μA), i.e., $|Ia_2|>|Ia_1|/5$ is the same as in the case where the image carrier 2 is negatively charged. Even in the case where the image carrier 2 is positively charged, the above-mentioned advantages of the present invention can be obtained.

Although the transfer belt used in the present invention is applied to the intermediate transfer belt 8 onto which a toner image is primary transferred from the image carrier 2 and from which the transferred toner image is secondary transferred onto a transfer material such as a paper in the image forming apparatus 1 of the above examples.

However, the transfer belt used in the present invention is not limited to this but may be a transfer belt for feeding a transfer material such as a paper onto which a toner image on the image carrier 2 is directly transferred.

What is claimed is:

1. A charger comprising:

a charging brush which is rotatably provided and is brought into contact with an image carrier to charge the surface of the image carrier;

a charging roller which is brought into contact with the image carrier at a portion on the downstream side relative to the charging brush in the rotational direction of the image carrier to charge the surface of the image carrier; and a controller which controls voltages applied to the charging brush and charging roller, wherein the controller controls voltages applied to the charging brush and charging roller such that one-fifth of the absolute value of a charging brush current flowing between the image carrier and charging brush is lower than the absolute value of a charging roller current flowing between the image carrier and charging roller.

2. An image forming apparatus comprising at least:

an image carrier which is rotatably provided and on the surface of which an electrostatic latent image is formed;

a charger for charging the image carrier;

a writing unit for writing the electrostatic latent image onto the image carrier;

a developing unit for developing the electrostatic latent image formed on the image carrier so as to form a developer image onto the image carrier; and a transfer unit for transferring the developer image on the image carrier onto a transfer belt, wherein the charger is the charger as claimed in claim 1.

3. A charge control method comprising the steps of:

charging the surface of an image carrier by means of a charging brush which is rotatably provided and is brought into contact with the image carrier;

charging the surface of an image carrier by means of a charging roller which is brought into contact with the image carrier at a portion on the downstream side relative to the charging brush in the rotational direction of the image carrier, wherein charge of the image carrier by means of the charging brush and charging roller is performed under constant current control, charge control performed under the constant current control comprises: measuring a charging brush current flowing between the image carrier and charging brush; measuring a charging roller current flowing between the image carrier and charging roller; and controlling voltages applied to the charging brush and charging roller such that one-fifth of the absolute value of the charging brush current is lower than the absolute value of the charging roller current.

4. The charge control method according to claim 3, further including counting the rotation number of the image carrier, wherein, when the count value of the rotation number of the image carrier has reached a preset specified value, the absolute value of the charging brush current is set at a preset value higher than the absolute value of the charging brush current at that time.

* * * * *